US007505372B2

(12) United States Patent
Borg

(10) Patent No.: US 7,505,372 B2
(45) Date of Patent: Mar. 17, 2009

(54) ELECTRONICALLY CONTROLLED WATER CLOCK THAT INCLUDES VISUAL DISPLAYS FOR THE PASSAGE OF HOURS, MINUTES AND SECONDS

(76) Inventor: Chris Alan Borg, 720 14th St., Huntington Beach, CA (US) 92648

( * ) Notice: Subject to any disclaimer, the term of this patent is extended or adjusted under 35 U.S.C. 154(b) by 98 days.

(21) Appl. No.: 11/372,414

(22) Filed: Mar. 10, 2006

(65) Prior Publication Data

US 2007/0211576 A1 Sep. 13, 2007

(51) Int. Cl.
*G04B 1/26* (2006.01)

(52) U.S. Cl. ..... 368/65

(58) Field of Classification Search ..... 368/65, 368/93, 95

See application file for complete search history.

(56) References Cited

U.S. PATENT DOCUMENTS

| | | | | |
|---|---|---|---|---|
| 4,028,877 A * | 6/1977 | Vatterott | ..... | 368/65 |
| 4,262,348 A * | 4/1981 | Hess | ..... | 368/65 |
| 4,372,688 A * | 2/1983 | Chatten | ..... | 368/65 |
| 7,245,561 B2 * | 7/2007 | Coleman | ..... | 368/65 |

* cited by examiner

*Primary Examiner*—Gary Paumen

(57) ABSTRACT

An electronically controlled water clock designed to visually display the passage of hours, minutes and seconds by the gravitationally induced flowing away of liquid material inside transparent vessels, with each unit of time displayed in a separate vessel. Each vessel consists of an upper and lower chamber and an air tube connects the 2 chambers to equalize air pressure between them and to serve as an overflow drain for the upper chamber. The bottom end of the upper chamber has a small drain tube through which the liquid drains out. The front of the upper chamber is inscribed with a uniform scale and its interior shape is such that the upper surface of the liquid drops in equal vertical intervals over equal time spans throughout the entire time required to drain the upper chamber from the top to the bottom end of the scale. The lower chamber is either used as a reservoir to contain the draining liquid or it can be an inverted version of the upper chamber to show the passage of time as the liquid rises in the lower chamber. Time is indicated on the clock by the numbers on the uniform scales which correspond to the level of the liquid inside the vessels: the hour is given by the level of the liquid on the scale of the vessel measuring hours, the minute is given by the level of the liquid on the scale of the vessel measuring minutes and the second is given by the level of the liquid on the scale of the vessel measuring seconds. An electronic pump controlled by an electronic timer is attached to an aperture on the bottom of the lower chamber and it pumps the liquid out of the lower chamber and back into the upper chamber at a predetermined time so that the liquid can drain out of the upper chamber again. This cycle of slow draining followed by rapid refilling by the pump is repeated indefinitely. In order to maintain constant viscosity of the liquid, an electronic temperature controller is utilized. The controller uses a thermocouple in contact with the liquid to measure its temperature and an electric heating/cooling device attached to the outside of the vessel to supply or remove heat as needed to keep the liquid at a given temperature.

6 Claims, 5 Drawing Sheets

ELECTRONICALLY CONTROLLED WATER CLOCK THAT INCLUDES VISUAL DISPLAYS FOR THE PASSAGE OF HOURS, MINUTES AND SECONDS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to time keeping devices which measure the passage of predetermined intervals of time by the flowing away of liquid materials. The accuracy of such apparatus has been impaired primarily by changes in the physical properties of the liquid material employed. The unique design of this invention greatly reduces those variations by combining modern electronics with the classical concept of the ancient clepsydra to create an original form of water clock capable of unparallel precision.

BRIEF SUMMARY OF THE INVENTION

An electronically controlled water clock designed to visually display the passage of hours, minutes and seconds by the gravitationally induced flowing away of liquid material inside transparent vessels with each unit of time displayed in a separate vessel. Each vessel consists of an upper and lower chamber and an air tube connects the 2 chambers to equalize air pressure between them. The bottom end of the upper chamber has a short tube through which the liquid drains out. The front of the upper chamber is inscribed with a uniform scale and its interior shape is such that the upper surface of the liquid drops in equal vertical intervals over equal time spans throughout the entire time required to drain the upper chamber from the top to the bottom of the scale. The lower chamber is either used as a reservoir to contain the draining liquid or it can be an inverted version of the upper chamber to show the passage of time as the liquid rises in the lower chamber. Time is indicated on the clock by the numbers on the uniform scales which correspond to the level of the liquid inside the vessels: the hour is given by the level of the liquid on the scale of the vessel measuring hours, the minute is given by the level of the liquid on the scale of the vessel measuring minutes and the second is given by the level of the liquid on the scale of the vessel measuring seconds. An electronic pump controlled by an electronic timer is attached to an aperture on the bottom of the lower chamber and it pumps the liquid out of the lower chamber and back into the upper chamber at a predetermined time so that the liquid can drain out of the upper chamber again. This cycle of slow draining followed by rapid refilling by the pump is repeated indefinitely. In order to maintain constant viscosity of the liquid an electronic temperature controller is utilized. The controller uses a thermocouple in contact with the liquid to measure its temperature and an electric heating/cooling device attached to the outside of the vessel to supply or remove heat as needed to keep the liquid at a given temperature.

DETAILED DESCRIPTION OF THE INVENTION

Figure 9:
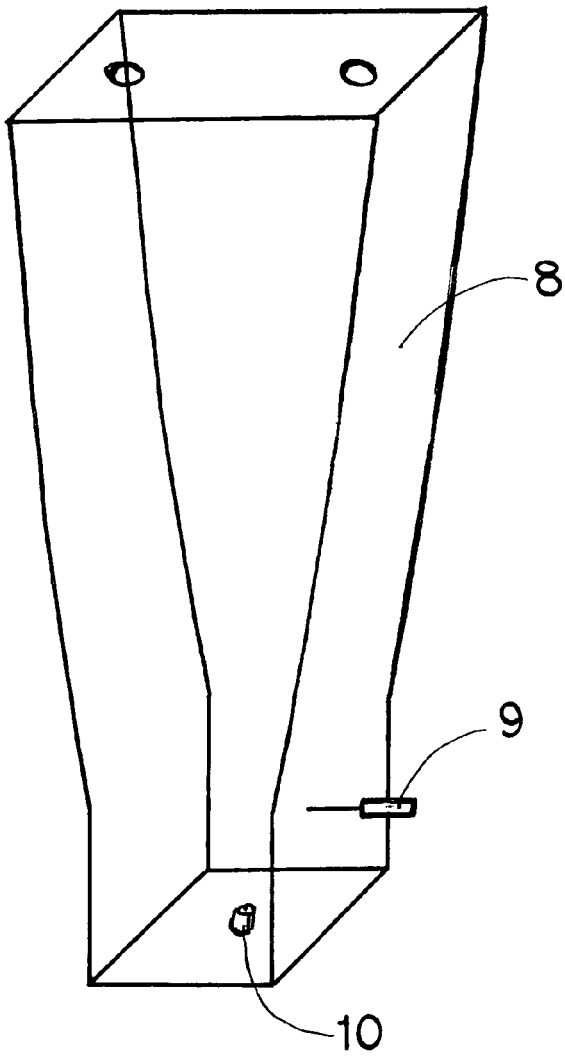
FIG. 9 is a 3-dimensional view of the transparent upper chamber of a vessel which only displays time in its upper chamber, showing the 2 apertures in the top, drain tube in the bottom and the thermocouple probe which is inserted into the neck of the chamber.
Figure 10:
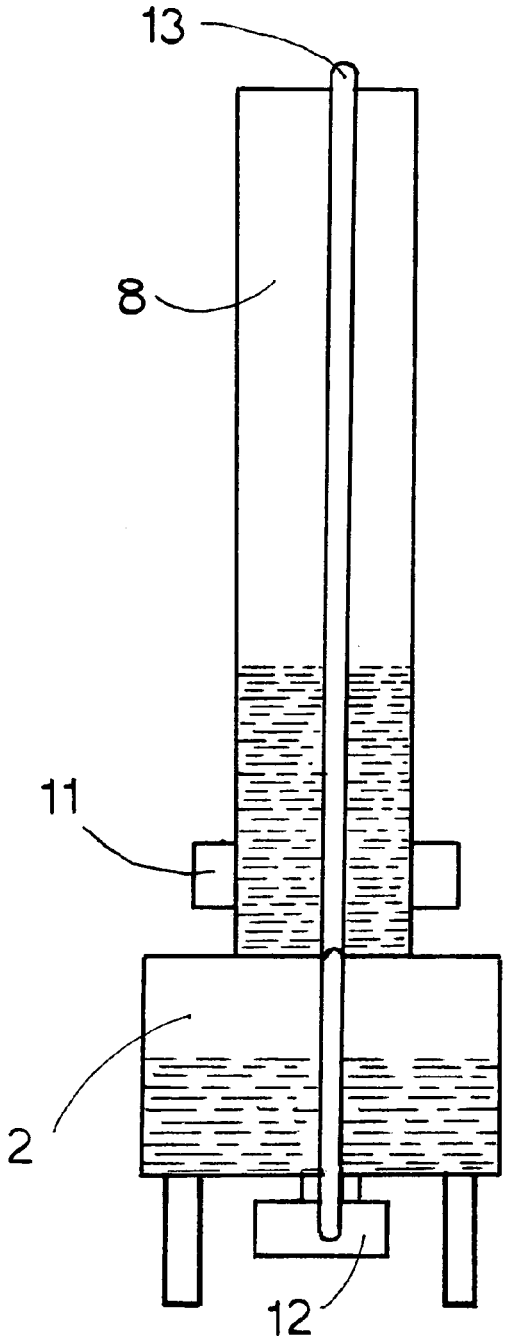
FIG. 10 is a 2-dimensional side view of an upper chamber of FIG. 9 attached to a lower chamber of FIG. 3. The Peltier heating/cooling devices and shown attached to the front and back of the neck of the upper chamber, the pump is shown attached to the bottom of the lower chamber and a liquid tube is shown running from the outlet of the pump to the top of the upper chamber. Liquid is shown in both chambers.
Figure 11:
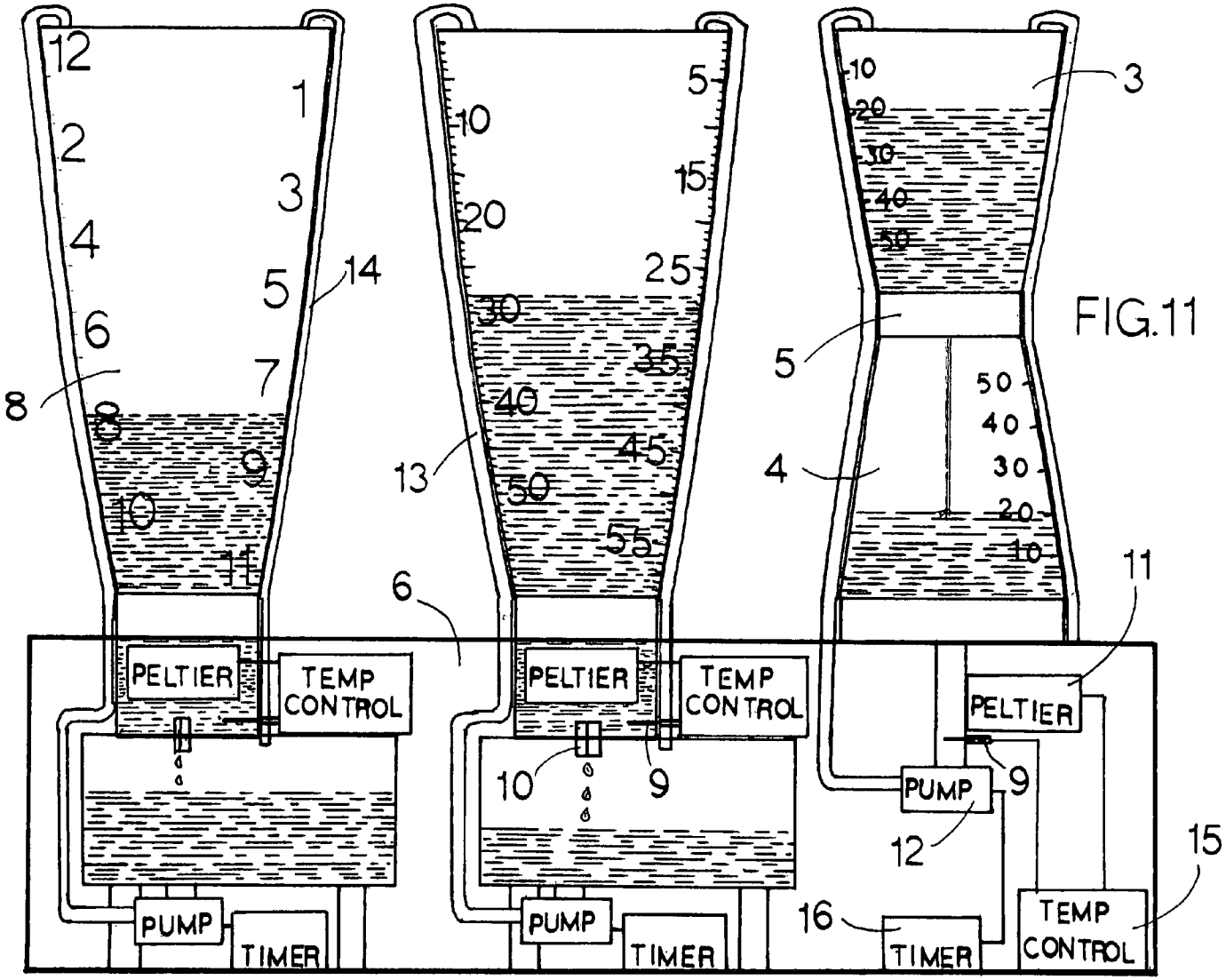
FIG. 11 is a 2-dimensional front view of the complete water clock of FIG. 12, minus the front base cover of FIG. 8, the vessel caps of FIG. 1 and the base collars shown in FIG. 7. It shows the upper chamber of FIG. 4 attached to the lower chamber of FIG. 5 with the vessel collar of FIG. 6 located between the 2 chambers. The upper chambers of FIG. 9 are shown connected to the lower chambers of FIG. 3. The Peltier heating/cooling devices are shown attached to the necks of the upper chambers of FIG. 9 and the drain pipe below the lower chamber of FIG. 5. The temperature control units are shown wired to the Peltier heating/cooling devices. The pumps are shown connected to the bottom of the lower vessels and are wired to their timers. Liquid is shown draining out of the drain tubes in the upper chambers and into the lower chambers.
Figure 12:
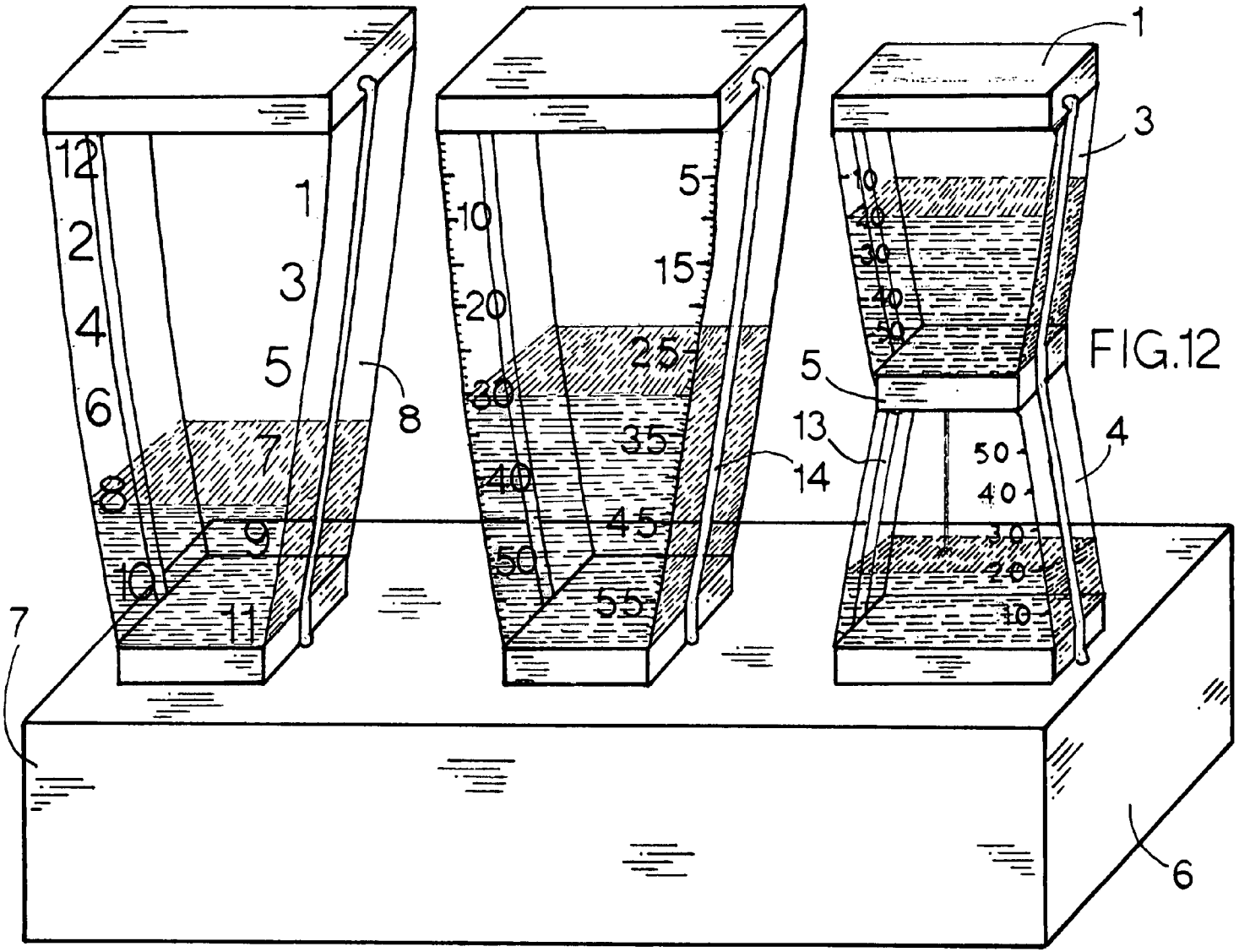
FIG. 12 is a 3-dimensional view of the complete water clock showing the vessel caps of FIG. 1 attached to the tops of the upper chambers of FIG. 4 and FIG. 9, the upper chamber of FIG. 4 attached to the lower chamber of FIG. 5 with the vessel collar of FIG. 6 located between the 2 chambers, the upper vessels of FIG. 9 and lower vessel of FIG. 5 connected to the clock base of FIG. 7 and the front base cover of FIG. 8 attached to the base. Air tubes and liquid tubes are shown running between the base and the tops of the upper vessels. Liquid is shown in the vessels indicating a time of 8:30:20.

Referring to FIG. 12, an electronically controlled water clock which can visually display the passage of hours, minutes and seconds by the gravitationally induced flowing away of liquid material at a uniform rate of descent adjacent to a uniform scale on a transparent surface and consisting of separate vessels for each unit of time displayed and electronic apparatus used to control the temperature of the liquid and pump the liquid from the lower portion of the vessels to the upper portion of the vessels at predetermined intervals. Each vessel has an upper and lower chamber as shown in FIG. 11 and each upper chamber has a drain tube in the bottom through which the liquid drains out as shown in FIG. 4, FIG. 9 and FIG. 11. There are 2 different types of vessels. FIG. 10 and FIG. 11 show the vessel which has the transparent upper chamber of FIG. 9 connected to the lower chamber of FIG. 3. In that type of vessel the passage of time is shown only in the upper chamber as the liquid drains out of the upper chamber and descends down the uniform scale inscribed on the outside of the upper chamber. The lower chamber of FIG. 3 acts as a reservoir to contain the liquid as it drains. The other type of vessel is shown in FIG. 11 and FIG. 12. In that vessel the upper chamber of FIG. 4 is connected to the lower chamber of FIG. 5, with the vessel collar of FIG. 6 located between the chambers acting to both hold them together and to conceal the drain tube of the upper chamber and the air tube of the lower chamber. Both of those upper and lower chambers have a uniform scale inscribed on their transparent front surfaces and both chambers display the passage of time, with the upper chamber displaying the passage of time as the liquid in it descends and the lower chamber displaying the passage of time as the liquid in it rises. In order for the liquid to descend at a uniform rate through the entire length of time required to drain the upper chamber from the top to the bottom of its uniform scale, the body of the upper chambers of FIG. 4 and FIG. 9 must have an interior shape of a paraboloid or a parabolic trough. The lower chamber of FIG. 5 also has the same requirement.

The rate at which the liquid will flow out of the upper chamber is determined by the depth of the liquid, the length and inner diameter of the drain tube in the bottom of the upper chamber and the viscosity of the liquid. The rate at which the liquid descends in the upper chamber is determined by the length and inner diameter of its drain tube, the interior volume of the body of the upper chamber and the viscosity of the liquid. The viscosity of the liquid is determined by its temperature. To keep viscosity at a constant value the liquid's temperature must be kept at a constant value. This is accomplished by using a temperature regulating system which consists of a process/temperature controller, thermocouple and a Peltier thermoelectric cooler/heater. The thermocouple probe is inserted into the liquid as shown in FIG. 9 and FIG. 11. Peltier thermoelectric cooler/heaters are attached to the outside of the neck of the upper chamber of FIG. 9 as shown in FIG. 10 and FIG. 11 and the drain pipe under the lower chamber of FIG. 5 as shown in FIG. 11. The process/temperature controller is wired to the thermocouple probe and the Peltier thermoelectric cooler/heater as shown in FIG. 11. The controller monitors the output signal from the probe. When the liquid's temperature falls below the preset value the controller causes the Peltier device to act as a heat source and warms the liquid. When the liquid's temperature rises above the preset value the controller causes the Peltier device to act as a heat sink and cools the liquid.

In order to maintain equal air pressure in the upper and lower chambers of each vessel an air tube runs from an aperture on the top of the lower chamber to the an aperture on the top of the upper chamber as shown in FIG. 11. This air tube also serves as an overflow drain to ensure that the upper chamber is not over filled. After the upper chamber has been filled to the top of its inscribed scale any excess liquid pumped in will flow out the overflow tube and back into the lower chamber.

Figure 3:
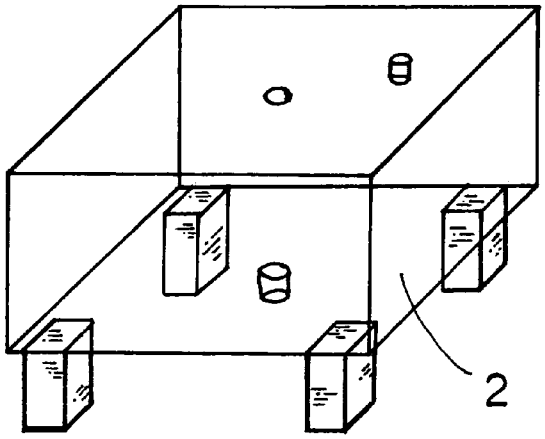
FIG. 3 is a 3-dimensional view of the lower chamber of a vessel showing its transparent body with 2 apertures in the top and 1 aperture in the bottom and the 4 support legs attached to the outside of the bottom.
Figure 4:
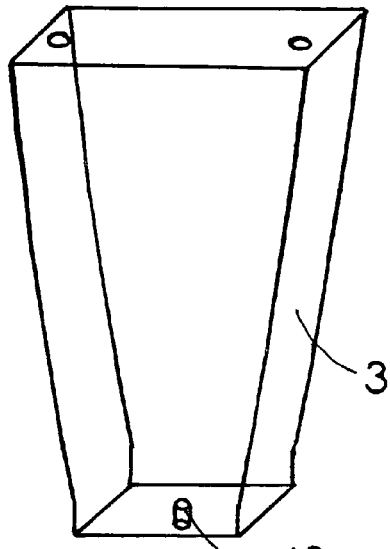
FIG. 4 is a 3-dimensional view of the transparent upper chamber of a vessel which displays time in both its upper and lower chambers, showing the 2 apertures in the top and a drain tube in the bottom.
Figure 5:
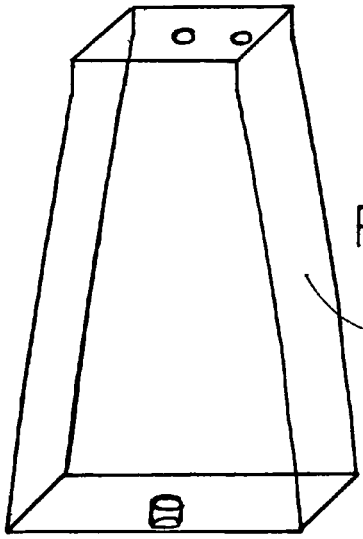
FIG. 5 is a 3-dimensional view of the transparent lower chamber of a vessel which displays time in both its upper and lower chambers, showing the 2 apertures in the top and 1 aperture in the bottom.

The lower chambers of FIG. 3 and FIG. 5 have a pump connected to the aperture in the bottom of the chambers as shown in FIG. 10 and FIG. 11. Each pump is controlled by an electronic timer wired to the pump as shown in FIG. 11. The timers are set to run the pumps at the appropriate time interval for each vessel. The timer of the pump on the vessel displaying the passage of hours turns on the pump at exactly 12:00 AM and 12:00 PM, minus the amount of time required for the pump to completely fill the upper vessel. If that fill time takes 20 seconds then the timer will turn on the pump at 20 seconds before noon and 20 seconds before midnight so that the liquid level will be right at the top of the uniform scale on the upper chamber of the vessel which measures hours at 12:00 PM and 12:00 AM. In a like manner, the timer that controls the pump of the vessel which displays the passage of minutes turns the pump on at exactly the start of each hour minus the time required to fill that upper chamber, and the timer that controls the pump on the vessel which displays the passage of seconds turns the pump on at the exact start of each new minute minus the time required to fill that upper chamber. Since the vessel displaying the passage of seconds contains a relatively small volume of liquid it can be filled in just a few seconds. All the timers keep their pumps running for a short time longer than the time required to fill the upper chambers to insure that those chambers are completely filled and since any excess liquid pumped in will just flow out the overflow tube. After the pump is turned off, the liquid remaining in the liquid tube between the outlet of the pump and the top of the upper chamber will drain back through the pump. In the vessels which only display the passage of time in the upper chamber, the liquid that drains back will flow into the bottom of the lower chamber until the level of the liquid in the liquid tube and in the lower chamber is equal. For the vessel which displays the passage of time in both its upper and lower chambers, the amount of liquid that flows back after the pump shuts off is calculated to level off at the bottom of the inscribed scale of the lower chamber. The cycle of slow draining of the chambers displaying the passage of time followed by their rapid refilling is repeated indefinitely.

Time is indicated on the water clock by the numbers on the uniform scales which correspond to the level of the liquid inside the vessels: the hour is given by the level of the liquid on the scale of the vessel measuring hours, the minute is given by the level of the liquid on the scale of the vessel measuring minutes and the second is given by the level of the liquid on the scale of the vessel measuring seconds. The time shown on the water clock of FIG. 11 is 8:28:20.

Figure 1:
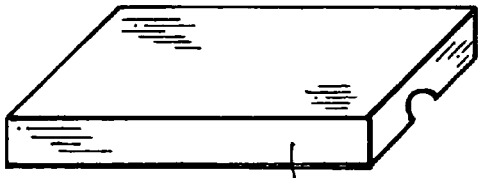
FIG. 1 is a 3-dimensional view of a vessel cap. There are a total of 3 vessel caps.
Figure 2:
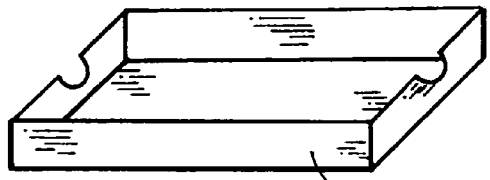
FIG. 2 is a 3-dimensional bottom view of FIG. 1.
Figure 6:
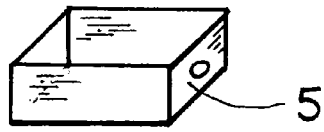
FIG. 6 is a 3-dimensional view of the vessel collar which fits between the upper chamber of FIG. 4 and the lower chamber of FIG. 5 as shown in FIG. 11 and FIG. 12, showing the aperture through which an air tube passes.
Figure 7:
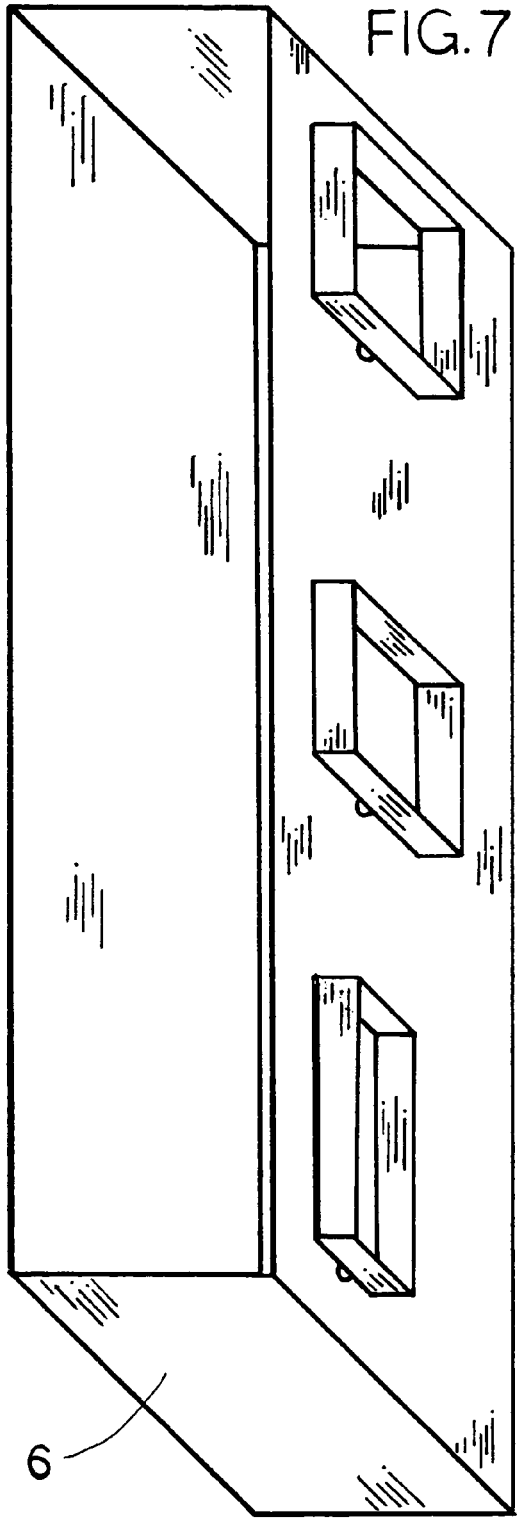
FIG. 7 is a 3-dimensional view of the water clock base, with its front cover removed, showing the 3 base collars around the openings in the top of the base which secure the vessels as shown in FIG. 12.
Figure 8:
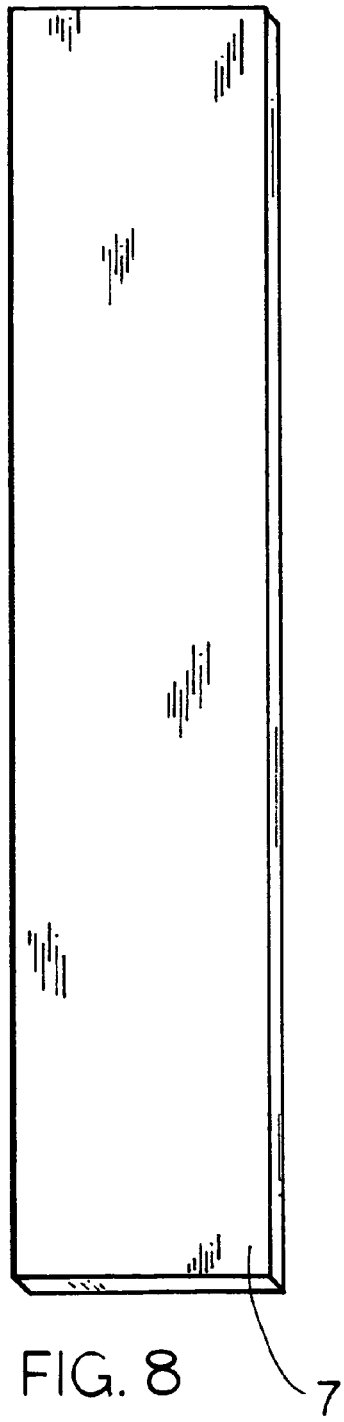
FIG. 8 is a 3-dimensional view of the base front cover. It attaches to the front of the base as shown in FIG. 12.

This paragraph describes the construction of the invention. The parabolic sections which form the front and back of the upper chambers of FIG. 4 and FIG. 9 and the lower chamber of FIG. 5 are traced out on a clear acrylic sheet and then cut out. The side sections of those chambers are produced in the same way along with the top and bottom sections. The desired uniform time scales are inscribed on the front parabolic sections, with the scale numbers and graduation marks starting at the top to the parabolic section and ending at the bottom of the parabolic section. 2 holes are drilled in the top sections for the air tube and liquid tubes and one hole is drilled in the bottom section for the drain tube. A small hole for the thermocouple probe is drilled into the neck area of the front piece of the chamber in FIG. 9 and the drainpipe shown below the lower chamber of FIG. 5 in FIG. 11. The edges of the front and side sections are joined together with acrylic solvent glue then the back, top and bottom sections are glued in place. The drain tubes are inserted into the bottom of the vessels and secured in place with sealant. The thermocouple probes are inserted into the holes drilled for them and then secured in place with sealant. The top, bottom and side sections of the lower chamber of FIG. 3 are cut out from a clear acrylic sheet. 2 holes are drilled through the top section for the drain tube of the upper chamber to fit through and the attachment of an air tube. 1 hole is drilled through the bottom section for attachment of the input line of the pump. The edges of all the sections are then joined together with the acrylic glue. The support legs are glued to the underside of the bottom section as shown in FIG. 3. The rectangular sections of the vessel caps for FIG. 1 and vessel collar of FIG. 6 are cut out of non-transparent plastic sheet and then those sections are glued together. A hole is drilled in one side of the vessel collar to allow for the passage of an air tube from the top of the lower chamber of FIG. 5. The front base cover of FIG. 8 is cut out of a sheet of non-transparent plastic as are the top, sides, and bottom sections of the clock base of FIG. 7. The sections for the collars on the top of the base are produced in the same way. Those collar sections are then glued together. Rectangular openings are cut out of the top section of the base and then the base collars are glued around the openings as shown in FIG. 7. The top, sides and bottom of the base are glued together. The pumps are connected to the bottom of the lower chambers of FIG. 3 as shown in FIG. 10 and FIG. 11, and the drain pipe of the lower chamber of FIG. 5 as shown in FIG. 11. Sealant is applied around the pump connection. The lower chambers and the drain pipe are then placed in the clock base of FIG. 7 and the electronic timers are wired to the pumps as shown in FIG. 11. The upper chambers of FIG. 9 are lowered into the base collars shown in FIG. 7 until they rest on top of the lower chambers of FIG. 3 as shown in FIG. 11. Sealant is applied around the connection between the upper and lower chambers. The lower chamber of FIG. 5 is lowered into the base collar and connected to its drainpipe. Sealant is applied around that connection. The vessel collar of FIG. 6 is fit onto the top of the lower chamber of FIG. 5 and an air tube is connected to one of the apertures on the top of the lower chamber and the other end of that tube is run through the hole in the vessels collar. Sealant is applied to the outside of the lower chamber top and then the upper chamber of FIG. 4 is placed into the top of the vessel collar. The air tube running through the vessel collar is then attached to the side of the upper chamber of FIG. 4 and then the air tube is connected to an aperture on top of that upper chamber as shown in FIG. 11. Sealant is applied around the connection. Air tubes are connected to the aperture in the top of the lower chambers of FIG. 3 with sealant applied around the connection. That tube is pushed up through the hole in the top side of the clock base shown next to the base collars in FIG. 7 and attached to the side of the upper chamber above it. The air tube coming up from the lower chamber is connected to an aperture on top of the upper chamber as shown in FIG. 11 and sealant is applied around that connection. The Peltier thermoelectric heating/cooling device is attached to the necks of the upper chambers of FIG. 9 and the drain pipe of the lower chamber of FIG. 5 as shown in FIG. 11. The temperature controllers are wired to the thermoelectric devices and the thermocouples then they are placed inside the clock base as shown in FIG. 11. A liquid tube is attached to the output nozzle of the pumps. The other end of those tubes are pulled up through the holes beside the base collars and attached to the sides of the chambers of FIG. 9. Double distilled water is poured into the upper chambers through the open aperture in the top of the chambers to serve as the water clock's liquid material. Then the ends of the liquid tubes which are attached to the sides of the upper chambers and connected to the open apertures as shown in FIG. 11 and sealant is applied around those connections. Each complete vessel assembly with its chambers, pump, liquid tube and air tube is then a closed system in which material can neither exit nor enter unintentionally. The vessel caps of FIG. 1 are pressed on to the tops of the upper chambers and the base front cover of FIG. 8 is installed on the front of the base of FIG. 7 as shown in FIG. 12. The water clock is now completely assembled. The temperature controllers are set to maintain the desired liquid temperature, the timers are set to turn the pumps on at the desired times for the desired intervals and the water clock will display the passage of time.

While there has been shown and described a preferred embodiment of the electronically controlled water clock of this invention, it is understood that changes in the structure, materials, sizes, shapes and electronic components can be made by those skilled in the art without departing from the invention. The invention is defined in the following claims.

I claim:

1. A clock which can visually display time and the passage of various units of time with liquid descending and/or ascending at a uniform rate adjacent to a uniform scale due to the pull of gravity and that consists of a singular vessel or separate vessels for each unit of time displayed and electronic apparatus used to control the temperature of the liquid and to pump the liquid from the lower area of the vessel(s) back up to the upper area of the vessel(s) to perpetuate a continuous cycle of slow draining followed by rapid refilling and/or slow filling followed by rapid draining in the display area of the vessel(s).

2. The clock of claim 1 in which said vessel(s) consist(s) of an upper and lower chamber with the upper chamber serving to display time and the passage of time as liquid drains out of it and comprising: a top, a main body with an interior shape such that the liquid drops in equal vertical intervals over equal time spans, a transparent front inscribed with the said uniform scale and a bottom that has a drain tube through which the liquid drains out, where said drain tube may include a filter, while the lower chamber either serves as a reservoir to hold the draining liquid and is composed of a container with a top having 2 or more apertures and a bottom which may include a number of apertures, or the lower chamber functions to display time and the passage of time as the liquid drains into it and has the shape of an inverted upper chamber with a transparent front inscribed with a uniform scale, a top with 2 or more apertures and a bottom which may include a number of apertures.

3. The water clock of claim 1 wherein said electronic apparatus consists of a pump with the pump's input line connected to: the aperture in the bottom of the vessel's lower chamber or the l ower interior of that chamber, and the pump's output line connected to the upper interior of the upper chamber, a timer which determines when and/or for how long the pump will pump liquid up into the upper chamber, and a temperature control system consisting of a device to measure the liquid's temperature, a heating/cooling device and a processor which acts to maintain the temperature of the liquid at a constant value.

4. The clock of claim 1 wherein a tube connects an aperture on the top of the lower chamber to the upper interior of the upper chamber and serves to keep air pressure in the 2 chambers equal and as an overflow drain to ensure that the upper chamber is not over filled.

5. The clock of claim 1 wherein said clock may include a base designed to securely hold the vessel(s) in place in such a way that the display area(s) of the vessel(s) are visible while the lower portions of the vessel(s) and/or the controlling electronic apparatus are protected and/or shielded from view, and vessel caps may be used to cover and protect the top(s) of the vessel(s).

6. The clock of claim 1 wherein the time is indicated on said clock by the numbers on the uniform scale(s) which correspond to the level of the liquid inside the vessel(s).

* * * * *